United States Patent [19]

Frost et al.

[11] 4,300,319

[45] Nov. 17, 1981

[54] BUILDING EAVES SHIELD

[75] Inventors: Paul E. Frost, Plainfield; James R. Stewart, Indianapolis, both of Ind.

[73] Assignee: New Stone, Inc., Indianapolis, Ind.

[21] Appl. No.: 82,950

[22] Filed: Oct. 9, 1979

[51] Int. Cl.[3] ..... E04D 13/00

[52] U.S. Cl. ..... 52/11; 52/94; 248/48.1

[58] Field of Search ..... 52/11, 94, 96, 58, 15; 248/48.1, 48.2

[56] References Cited

U.S. PATENT DOCUMENTS

| | | | |
|---|---|---|---|
| 3,098,322 | 7/1963 | Greene | 52/11 |
| 3,344,563 | 10/1967 | Miles et al. | 52/11 |
| 3,436,877 | 4/1969 | Gunning | 52/11 |
| 3,550,381 | 12/1970 | South | 52/11 X |
| 3,612,453 | 10/1971 | Zimmer | 52/11 X |
| 4,195,452 | 4/1980 | Smith et al. | 52/11 |

*Primary Examiner*—Price C. Faw, Jr.
*Assistant Examiner*—Carl D. Friedman
*Attorney, Agent, or Firm*—Woodard, Weikart, Emhardt & Naughton

[57] ABSTRACT

An improved building eaves construction and eaves shield in which the shield comprises a first plate angled to match the pitch of a building roof underlying its normal roof covering, a second plate oriented to fit flush against the fascia board or exterior wall siding forming the roof edge, and a central, overlapping portion overlaying the roof edge and connecting the two plates. This central portion forms a downwardly opening channel into which the inner wall of a conventional gutter is inserted for attachment with the second plate to the fascia board or exterior wall siding to thereby prevent excess water, ice, or snow from backing up into the eaves area and damaging either the roof decking or the building interior.

7 Claims, 4 Drawing Figures

BUILDING EAVES SHIELD

BACKGROUND OF THE INVENTION

This invention relates to building construction and, in particular, to an eaves shield covering that spans the rafter and fascia junction at a building eaves and provides for secure gutter attachment while also preventing ice, snow, and rain from backing under the roofing shingles and damaging the building interior.

In a conventional pitched-roof building construction, such as a single- or multiple-family dwelling, a plurality of roof rafters attach at a central, or peak, beam and run at a predetermined pitch to secure atop the outer structural walls. In some buildings, the rafters stop at this point, being cut to match the vertical, planer surface of the building exterior. In other buildings, the rafters extend beyond the outer structural walls anywhere from about six inches to about eighteen inches forming a pocket in which the lower border of the roof that overhangs the exterior wall is commonly referred to as the eaves. This eaves area is either left exposed or is finished off with an outer, vertical backboard or fascia and a horizontal soffit board connecting the lower end of the fascia with the building siding. In either construction, however, some form of finish gutter is attached to the rafter ends to handle water run off from the pitched roof.

In the building industry, roofs in general, and eaves constructions in particular, have attracted much attention and concern over the years. The term eaves construction in this context is meant to include the outer gutter in addition to the finish covering used to join the rafter ends with the exterior siding.

As to roofs, examples of this work include the invention of metal roofing shingles (Vallee, U.S. Pat. No. 4,079,561), a flashing system for flat roofs (Edwards, U.S. Pat. No. 3,405,485), a gravel stop spliced butt joint (Windle, U.S. Pat. No. 3,415,020), and a pocket rake for gable siding which conceals an irregular siding transition near a roof edge (Ramins, U.S. Pat. No. 3,735,538). Other examples include complex prefabricated, watertight roof structural systems such as those disclosed in the Simpson and Simpson et al. patents, U.S. Pat. Nos. 4,112,632, 3,909,998 and 4,077,171.

As to eaves constructions, industry concern and invention have been widespread. For example, two Stanford patents, U.S. Pat. Nos. 3,426,488 and 3,821,512, disclose integral drip board, fascia board, and gutter combinations with possibly the most recent patent incorporating an electrically heated gutter and downspout feature. Kreimer, U.S. Pat. No. 4,069,628, discloses an eaves thermal baffle designed to prevent air and moisture from entering the building through the eaves-soffit area while also permitting insulation to be forced to the farthest exterior edges of the building for an effective and uniform insulation of the building interior. Scherf, U.S. Pat. No. 3,824,749, on the other hand, discloses a unitary gutter, soffit, and fascia structure designed to cut labor and material costs while increasing strength characteristics by replacing the entire roof overhand used in the majority of conventional building constructions.

Concern has also been expressed as to water damage to building exteriors and interiors occasioned at this eaves area. For example, Hutchisson, Jr. et al., U.S. Pat. No. 2,585,324, discloses a metallic eaves strip designed for use in providing a finished cornice structure on a flat-roof building. In particular, this strip joins the roofing material to the building siding and uses an anchoring rod or wire spline to support a folded sheet or strip whose flaps are upturned over the top surface of the cornice structure and interlace with any number of plys or layers of roofing material. A conventional gutter is sandwiched and nailed between this eaves strip and the outer surface of the cornice structure, or frame board. Greene, U.S. Pat. No. 3,098,322, on the other hand, discloses a preformed metallic covering to replace the entire fascia board, soffit, and wood starter course for the roofing shingles.

The above patent references constitute only a sampling of the work done in this area. Nevertheless, industry concern still centers on possible water damage to roof decking and building interiors caused by ice, snow, or water accumulating in the building gutters and backing up underneath the eaves area and roofing shingles. Applicant's present invention addresses this continuing problem.

SUMMARY OF THE INVENTION

One aspect of this invention comprises an eaves shield, including a first plate angled to match the pitch of a building roof underlying the normal roof covering, a second plate oriented to fit flush against the fascia board or outer wall joining the rafter ends, and a central overlapping portion overlaying the roof edge and joining the first and second plates. This central portion forms a downwardly opening channel into which the gutter is inserted prior to securing it to the fascia board or outer wall. Once in place, adhesive or other means are used to secure the roofing material over the first plate. By this assembly, with the eaves shield plates underlying both the roofing and gutter material, ice, snow, and water are totally prevented from backing up under the eaves area and damaging either the roof decking or the building interior. Other objects and advantages of the invention will become apparent from the detailed description to follow taken in connection with the accompanying drawings.

DESCRIPTION OF THE PREFERRED EMBODIMENT

Figure 1:
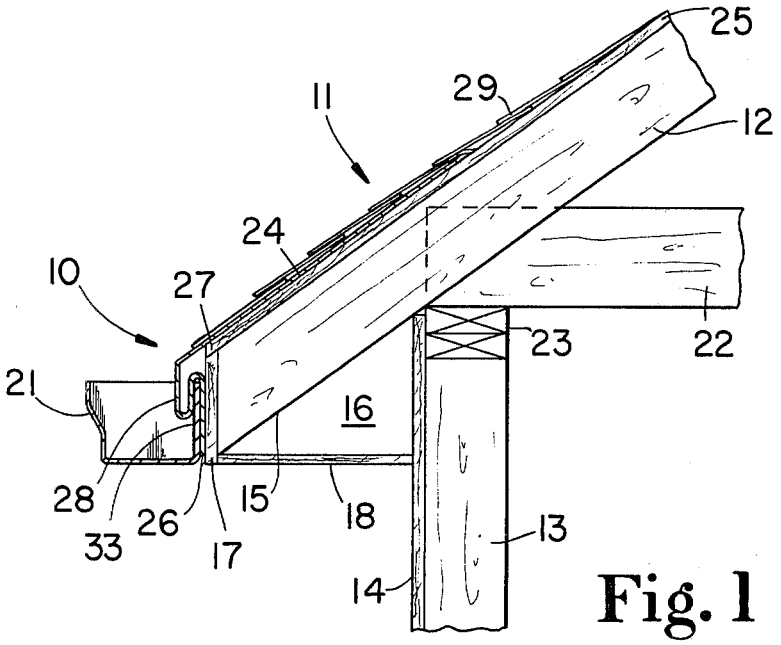
FIG. 1 is a sectional view of a building eaves construction equipped with the protective eaves shield comprising the preferred embodiment of applicant's invention.

As stated above, one aspect of this invention comprises an eaves shield for protecting the eaves area in a building construction from water or other damage. Applicant's preferred embodiment of this shield is depicted in the drawings accompanying this description and is generally indicated by reference numeral 10. Referring specifically to FIG. 1, a building eaves construction 11 is depicted in which the roofing rafters 12 extend outwardly of the supporting wall studs 13 and exterior wall covering 14 with their lower border 15 overhanging the wall to form the recognizable eaves area, generally depicted by reference numeral 16. The building eaves is completed by securing a vertical fascia board 17 to the rafter ends and connecting the lower end of this board to the outer wall 14 by means of a horizontal soffit board or frame 18. To further support rafters 12 and prevent the building's collapse, cross-beams or joists 22 secure between opposite walls 13 atop two horizontal boards 23 commonly referred to as the wall plate.

Unlike conventional constructions, and for the purpose of protecting the eaves area and providing a durable water-, snow-, and ice-resistant covering, applicant's preferred eaves shield 10 is secured to the rafter and fascia junction with gutter 21 attached thereto, all as further discussed hereinbelow.

Figure 2:
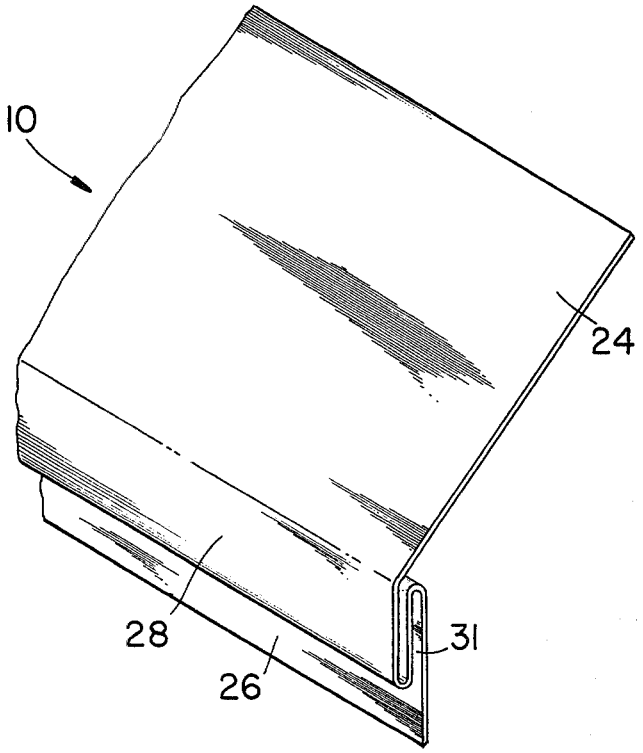
FIG. 2 is a perspective view of applicant's preferred eaves shield depicted in FIG. 1.
Figure 3:
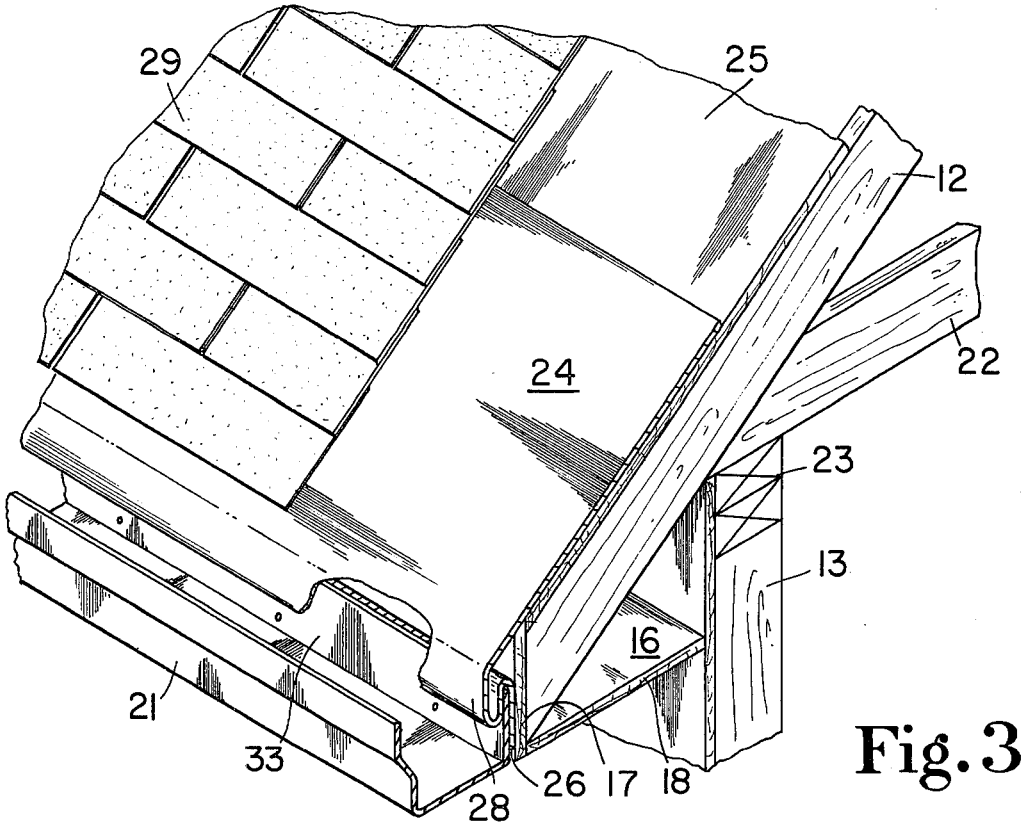
FIG. 3 is a perspective view of applicant's preferred building section in FIG. 1 with a portion broken away to better illustrate applicant's shield.

The specific construction of eaves shield 10 is better depicted in FIGS. 2 and 3. It includes a first plate or shelf 24 that secures directly to the roof decking 25 which is nailed to the upper surface of rafters 12. This plate is angled to match the pitch or slope of the roof, and underlies the conventional exterior roof covering such as wood or petroleum based shingles 29, or the like. This finished roof covering 29 is attached to the upper surface of plate 24 by a mastic adhesive or other known means. Where the shingles are of the "seal down" type to resist wind lifting, the adhesive material under the edges of such shingles can be adhered to plate 24, particularly at the lowermost, "starter" course of shingles.

A second plate or cover 26 is oriented to fit flush against fascia board 17 which meets rafters 12 at the roof end or edge 27. A central overlapping portion 28 overlays the roof edge and connects first and second plates 24 and 26, respectively. The central portion 28 provides structural support for the shield while also forming a downwardly opening channel 31. One of many conventional gutter constructions 21 is then positioned with its inner wall 33 inserted into channel 31, and the wall and second plate are both secured to the fascia board by conventional means such as nailing. In the context of describing the eaves shield itself, the expression "plate" is used merely to identify one portion as distinguished from another, since it will be noted that the preferred construction is a single roll-formed or extruded piece of aluminum, rather than an assembly of discrete plates.

In applicant's preferred constructions 10 and 11, the eaves area 16 is fully protected from water damage due to excess rain or to ice or snow build up. By securing gutter wall 33 within channel 31, and not sandwiched between second plate 26 and the fascia board, water, ice, and snow cannot creep or otherwise force its way behind shield 10 and into the eaves area where it can cause damage. In addition, excess water, ice, or snow build up over the top of gutter 21 is prevented from damaging the roof decking and building interior because of first plate 24 which underlies the lower shingles 29 or other roofing material.

Figure 4:
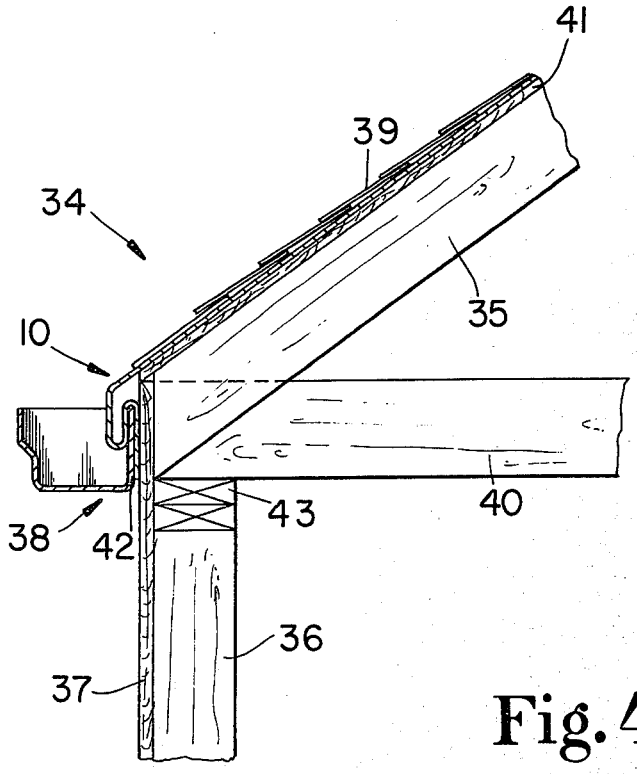
FIG. 4 is a sectional view of a second building eaves construction equipped with applicant's preferred eaves shield and constituting a second embodiment of applicant's present invention.

In FIG. 4 applicant's preferred eaves shield 10 is again used, but this time in combination with a second building eaves construction 34 in which the rafters 35 do not overhang the wall studs 36 and exterior wall covering 37. Instead, the rafters end in the same vertical, planer surface as the exterior siding 37 thereby forming an eaves area 38 without the need for a fascia or soffit board as in FIGS. 1 and 3. With this exception, however, applicant's preferred eaves shield 10 is constructed and used in FIG. 4 as described above with first plate 24 secured to the roof decking 41 and second plate 26 secured between gutter wall 42 and the exterior siding 37.

As to material selection and fabrication, much variation is accorded with applicant's eaves shield invention. Preferred shield 10, for example, is formed as a continuous, roll-formed extruded piece of 024 gauge aluminum stock with a mastic outer covering on first plate 24 to permanently seal down the roofing shingles or other finish covering. With preferred shield 10, first plate 24 is 16 inches long while central portion 28 and channel 31 are two inches in length and one-half inch in diameter, respectively. Second plate 26 is three inches in length and secured in place along with gutter wall 33 by galvanized roofing nails 44.

In the above paragraphs and accompanying drawings, it is understood that only applicants' preferred eaves shield and building constructions have been described and depicted. Advantages have also been touched upon, one major advantage being the prevention of water damage to roof decking or building interior previously caused by excess water, ice, or snow backing up into the eaves area. This will not be a problem with applicants' embodiments which protect the eaves area by securing the rear gutter wall within, and not behind, channel 31 in the eaves shield.

What is claimed:

1. A building eaves construction, comprising in combination:

a. a plurality of supporting wall studs spaced apart and standing on end to form a wall frame;

b. a horizontal board plate nailed across the top of said studs;

c. an exterior wall siding attached to said stud frame;

d. a plurality of roof rafters attached to said board plate and extending outwardly beyond said exterior wall siding a distance forming an overhanging eaves area;

e. a vertical fascia board attached to said rafter ends forming the roof edge;

f. a building roof fastened to said rafters and having an exterior roof covering;

g. an eaves shield, comprising:

1. a first plate angled to match the pitch of a building roof underlying the exterior roof covering;
2. a second plate oriented to fit flush against the fascia board at the roof edge; and
3. a central, overlapping portion overlaying the roof edge and connecting said first and said second plates, said central portion forming a downwardly opening channel for securing a gutter therein and against the fascia board.

2. The eaves shield in claim 1 wherein said shield is one continuous, extruded piece of aluminum.

3. The eaves shield in claim 1 wherein the upper surface of said first plate has an adhesive mastic coating to secure a conventional roof covering thereto.

4. A building eaves construction, comprising in combination:

a. a plurality of supporting wall studs spaced apart and standing on end to form a wall frame;

b. a horizontal board plate nailed across the top of said studs;

c. an exterior wall siding attached to said stud frame;

d. a plurality of roof rafters attached to said board plate and extending outwardly to said exterior wall siding to form a roof edge;

e. a roof decking attached to said rafters;

f. an eaves shield, comprising:

1. a first plate angled to match the pitch of said roof decking;
2. a second plate oriented to fit flush against said exterior wall siding at the roof edge; and
3. a central, overlapping portion connecting said first and said second plates and forming a downwardly opening channel therein;

wherein said central portion overlays the roof edge with said first plate attached to said roof decking and said second plate fitting flush against said exterior wall siding; and g. a gutter having a rear wall inserted into said channel and secured with said second plate to said exterior wall siding.

5. The buildings eaves construction in claim 4 wherein the rear wall of said gutter and said second plate are nailed to said exterior wall siding.

6. The building eaves construction in claim 5 additionally comprising a plurality of roofing shingles covering said roof decking and secured to the upper surface of said first plate by an adhesive mastic coating.

7. A building eaves construction, comprising in combination:

a. a plurality of supporting wall studs spaced apart and standing on end to form a wall frame;

b. a horizontal board plate nailed across the top of said studs;

c. an exterior wall siding attached to said stud frame;

d. a plurality of roof rafters attached to said board plate and extending outwardly beyond said exterior wall siding a distance between about six inches and about eighteen inches thereby forming an overhanging eaves area;

e. a vertical fascia board attached to said rafter ends forming the roof edge;

f. a horizontal soffit board connecting the lower end of said fascia board with said exterior wall siding;

g. a roof decking attached to said rafters;

h. an eaves shield, comprising:

1. a first plate angled to match the pitch of said roof decking;
2. a second plate oriented to fit flush against said fascia board at the roof edge; and
3. a central, overlapping portion connecting said first and said second plates and forming a downwardly opening channel therein;

wherein said central portion overlays the roof edge with said first plate attached to said roof decking and said second plate being flush against said fascia board; and i. a gutter having a rear wall inserted into said channel, said gutter wall and said second plate being nailed to the outer surface of said fascia board.

* * * * *